US005647338A

United States Patent [19]

Martin

[11] Patent Number: 5,647,338

[45] Date of Patent: Jul. 15, 1997

[54] SPORTS OBJECT LAUNCHER

[76] Inventor: Robert Martin, 3638 Challanger Ct., Palmdale, Calif. 93550

[21] Appl. No.: 532,437

[22] Filed: Sep. 22, 1995

Related U.S. Application Data

[63] Continuation-in-part of Ser. No. 299,955, Sep. 2, 1994, abandoned.

[51] Int. Cl.[6] ..... A63B 69/40; F41B 11/32

[52] U.S. Cl. ..... 124/75; 124/73

[58] Field of Search ..... 124/56, 70, 71, 124/73, 74, 75

[56] References Cited

U.S. PATENT DOCUMENTS

| | | | |
|---|---|---|---|
| 3,593,698 | 7/1971 | Culas | 124/73 |
| 3,640,263 | 2/1972 | Rhodes | 124/75 |
| 3,665,910 | 5/1972 | Boni | 124/73 |
| 4,774,928 | 10/1988 | Kholin | 124/75 |
| 5,282,455 | 2/1994 | Adamson et al. | 124/59 |
| 5,337,726 | 8/1994 | Wood | 124/73 X |
| 5,349,938 | 9/1994 | Farrell | 124/73 |
| 5,381,778 | 1/1995 | D'Andrade et al. | 124/73 X |
| 5,450,839 | 9/1995 | Nicolaevich et al. | 124/73 |

OTHER PUBLICATIONS

Brochure from Roll Seal Valve Company, Temecula, California. Sep. 1991.

*Primary Examiner*—John A. Ricci
*Attorney, Agent, or Firm*—Dennis W. Beech

[57] ABSTRACT

The sports object launcher is an air pressure powered fluid control valve with an aiming channel to direct a ball or hockey puck to a specific target. A simple commonly available throttling control fluid control valve is connected to a pressure vessel to provide air pressure. The outlet end of the fluid control valve is connected to a rectangular aiming channel in the case of hockey. When the fluid control valve is released, the released pressure launches the hockey puck out the exit end of the aiming channel. The aiming channel may be controlled to provide specific aiming when practicing a particular sport. In the case of use with hockey the air pressure system may be used to power air cylinders and control valves to position the aiming channel.

5 Claims, 4 Drawing Sheets

SPORTS OBJECT LAUNCHER

CROSS REFERENCES TO RELATED APPLICATIONS

This is a continuation-in-part of application Ser. No. 08/299,955 filed Sep. 2, 1994, now abandoned.

BACKGROUND OF THE INVENTION

1. Field of the Invention

This invention relates to devices used to throw, shoot or launch objects such as hockey pucks and balls for the practice of a particular sport. The new device provides a means to launch an object such as a hockey puck at a selected velocity to a particular target. The variation in velocity and location at which the object is launched provides for practice in reacting to and hitting the hockey puck or ball.

2. Description of Related Art

There are currently in use various types of devices for throwing or launching projectiles for practice in sports such as baseball and tennis. These devices typically involve a mechanical throwing arm which receives balls from a feed mechanism and rotates rapidly to hurl the ball at the player for purposes of practice at hitting the ball. Other devices such as a mechanical piston mechanism have also been used to basically push the balls out of a tube to provide velocity and direction. All such devices require complicated mechanical mechanisms in order to achieve the launching of the ball or object.

Devices using air or other gas under pressure are also available such as disclosed in U.S. Pat. No. 4,774,928. This device uses compressed air with a valve having a diaphragm that opens due to a pressure defferential thus causing a sudden release of air pressure. However, the pressure defferential control mechanism for the valve and diaphragm is quite complex thus creating an expensive mechanism with potential reliability problems. This system does not incorporate an accurate aiming mechanism.

While fluid control values such as disclosed in U.S. Pat. No. 4,198,029 are known in the art, these valves are designed and used in liquid systems. Application in gas applications has not been obvious. Use of such a valve in an gas pressure application such as the present invention is important for rapid valve opening and closing, for efficiency of launcher size and weight, and for minimizing complexity including the mechanical parts.

The present invention combines the use of a simple fluid control valve with an air pressure system and directional control mechanism to simply and accurately launch an object such as a hockey puck or ball to a given target for practice at hitting or deflecting the projectile. By use of a fluid control system the sports object launcher removes the need for complicated mechanical mechanisms while providing an accurate reliable system. Compressed air is used to launch the projectile by means of the fluid control valve and a cylindrical or rectangular tube or channel is used to aim the projectile in the desired direction.

SUMMARY OF THE INVENTION

A primary objective of the present invention is to provide the launching of an object such as a hockey puck or ball at a selected velocity in a selected direction by the use of gas pressure. A further object is to provide a method to aim the sports object launcher in a variety of directions to provide more realistic conditions for practice in a particular sport.

Another object is to provide variable velocity control for realistic practice. A further object is to provide an automatic projectile loading capability.

In accordance with the description presented herein, other objectives of this invention will become apparent when the description and drawings are reviewed.

DESCRIPTION OF THE PREFERRED EMBODIMENT

The sports object launcher consists of a fluid control valve attached to a pressure vessel on its inlet side and to an aiming channel on its outlet side. There is a pressure control system to pressurize the vessel and valve and to allow release of pressure to launch the projectile. The aiming channel may also have an aiming control system operated by the air pressure system or may utilize other aiming control mechanisms. The aiming channel may be provided with an automatic loading system to handle multiple projectiles or may be loaded individually.

Figure 1:
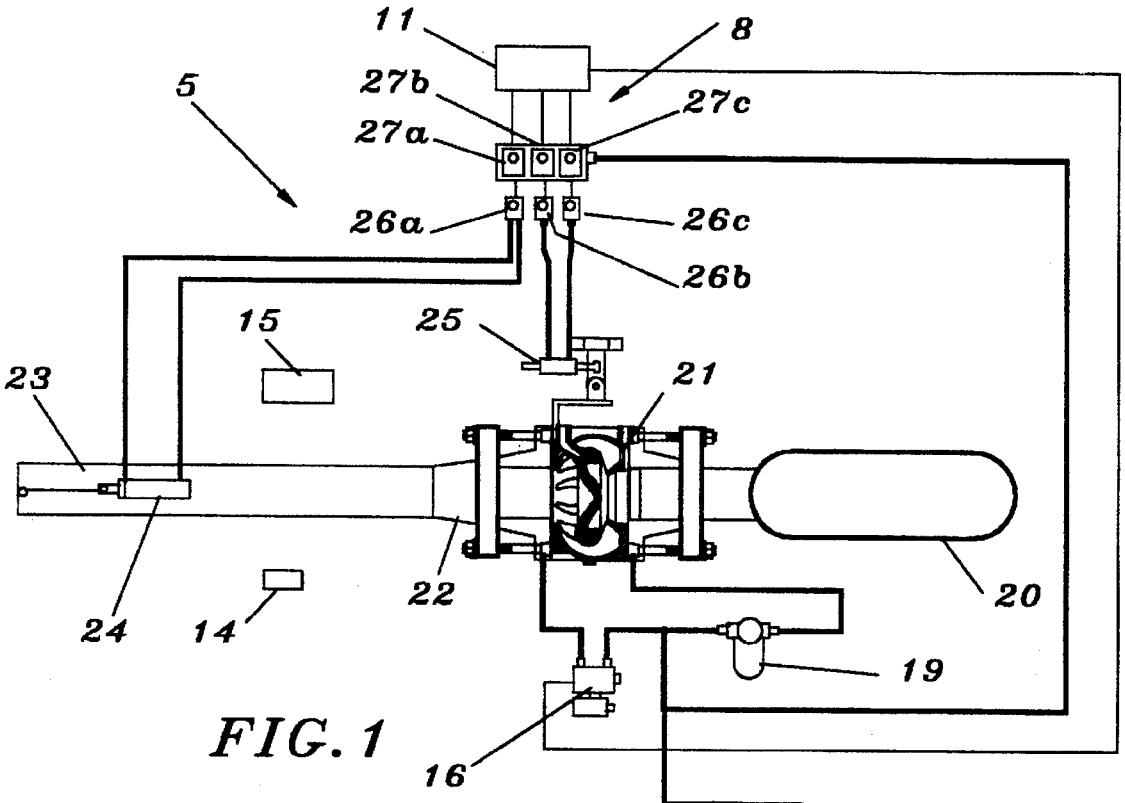
FIG. 1 illustrates a schematic view of the sports object launcher with fluid control aiming mechanism.
Figure 11:
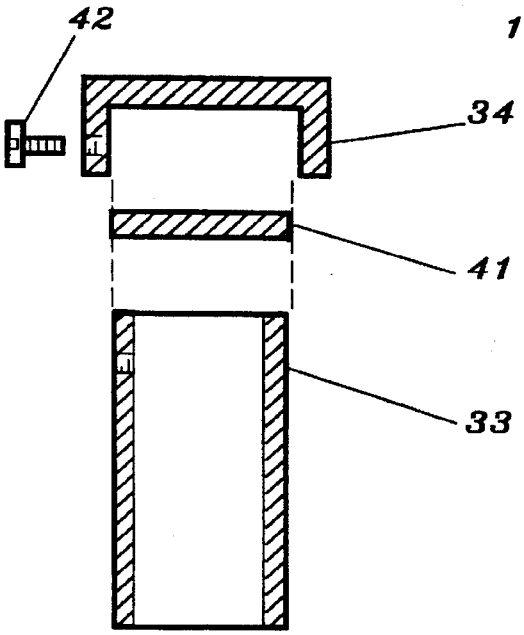
FIG. 11 illustrates a cross sectional view of the loader magazine.
Figure 12:
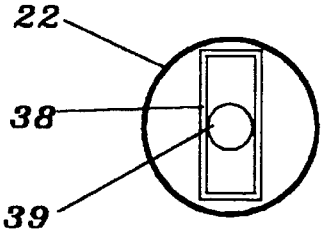
FIG. 12 illustrates a front view of the channel flow adapter.
Figure 13:
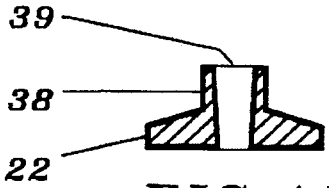
FIG. 13 illustrates a side cross sectional view of the channel flow adapter.
Figure 2:
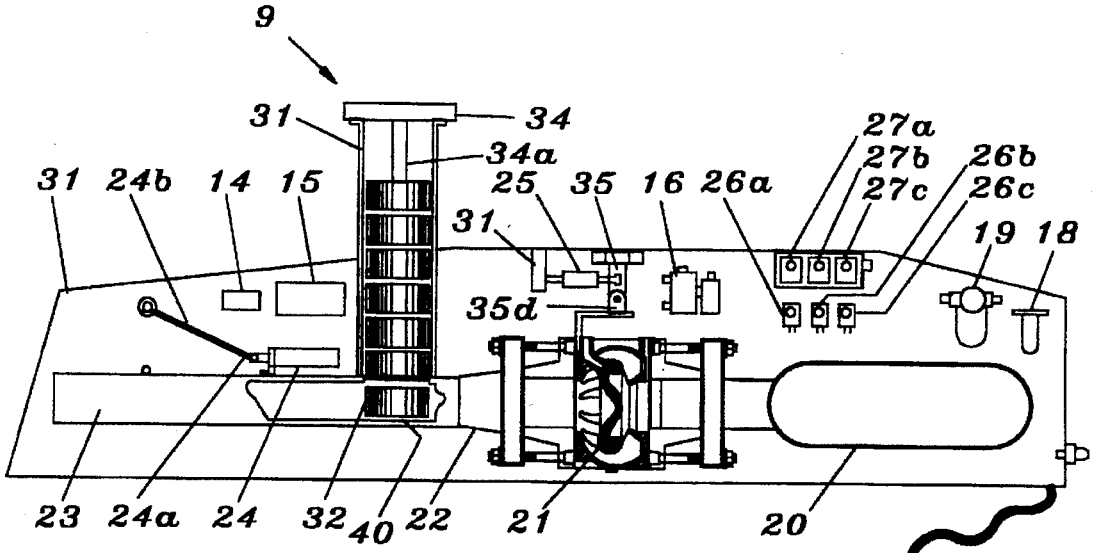
FIG. 2 illustrates a side view of the sports object launcher showing a cut away view of the fluid control valve.
Figure 3:
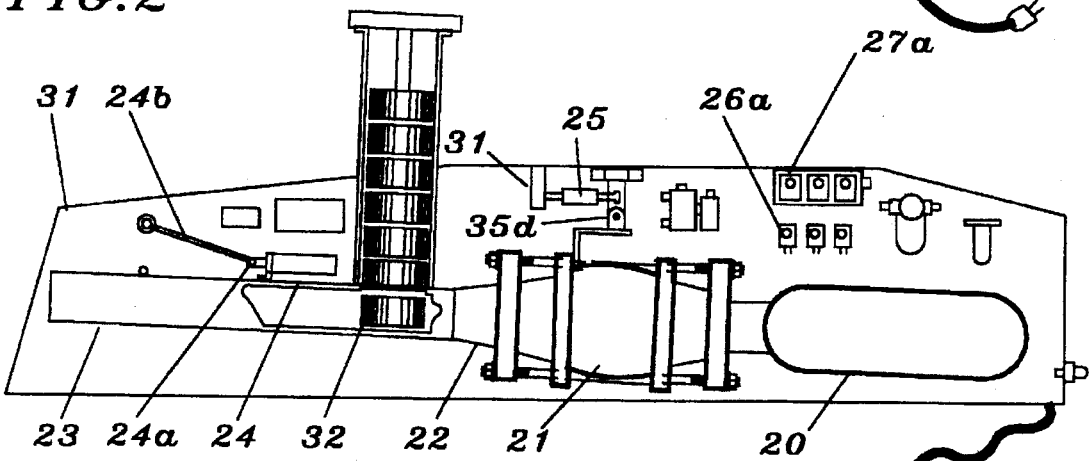
FIG. 3 illustrates a side view of the sports object launcher.
Figure 4:
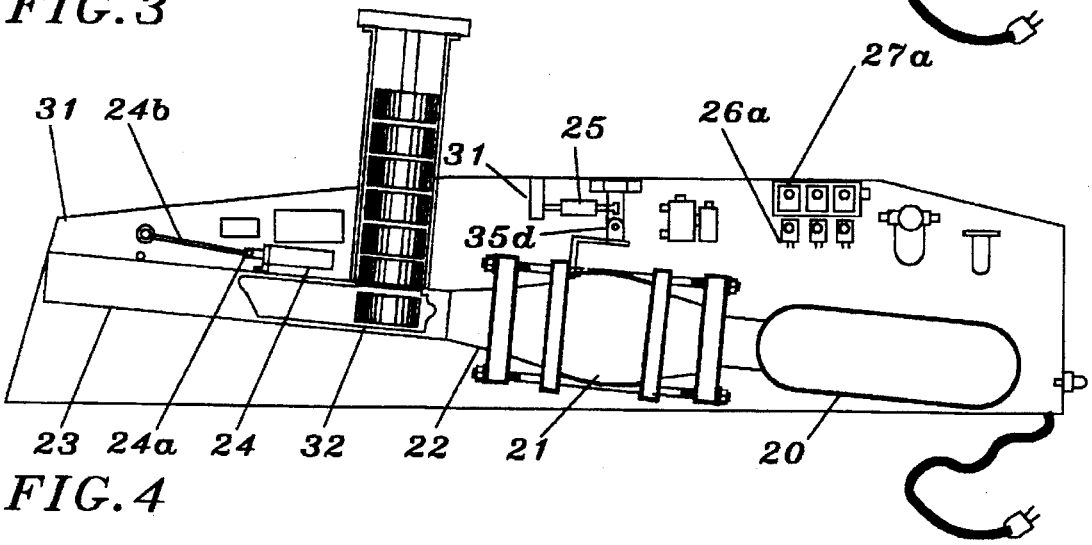
FIG. 4 illustrates a side view of the sports object launcher with the aiming channel elevated.

Referring to FIGS. 1 and 2 a fluid control valve (21) is connected at an inlet side (3) to a pressure vessel (20). The fluid control valve (21) outlet side (4) is connected to an aiming channel (23). The aiming channel (23) illustrated is rectangular in cross section to provide for use with hockey pucks (32). In this instance the aiming channel (23) is connected by means of an aiming channel adapter (22) as illustrated in FIG. 11 and 12. The aiming channel adapter (22) has a circular base for attachment to the pressure vessel (20) and rectangular port (38) with an aperture (39) therein. The aiming channel (23) has an automatic loader (9) attached to provide for storage of multiple objects such as hockey pucks (32) to allow continuous loading of the sports object launcher.

The fluid control valve (21) is connected at its outlet side (4) by a pilot valve line (6) through a pilot control valve (16) to a coalescent filter (18) and a gas source such as a gas compressor (2). In addition the inlet side (3) is connected by a gas supply line (7) through a gas regulator (19) to the coalescent filter (18) and gas compressor (2). These are the fluid control elements of the pressure control system (5) to operate the fluid control valve (21).

Figure 9:
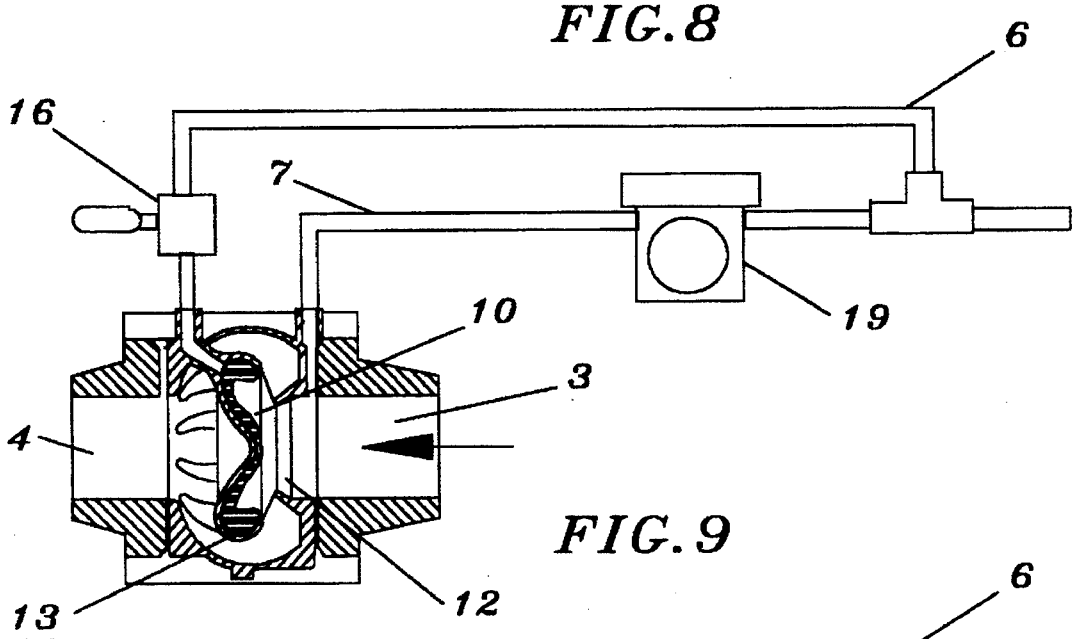
FIG. 9 illustrates a side schematic view of the fluid control valve in the open position.
Figure 10:
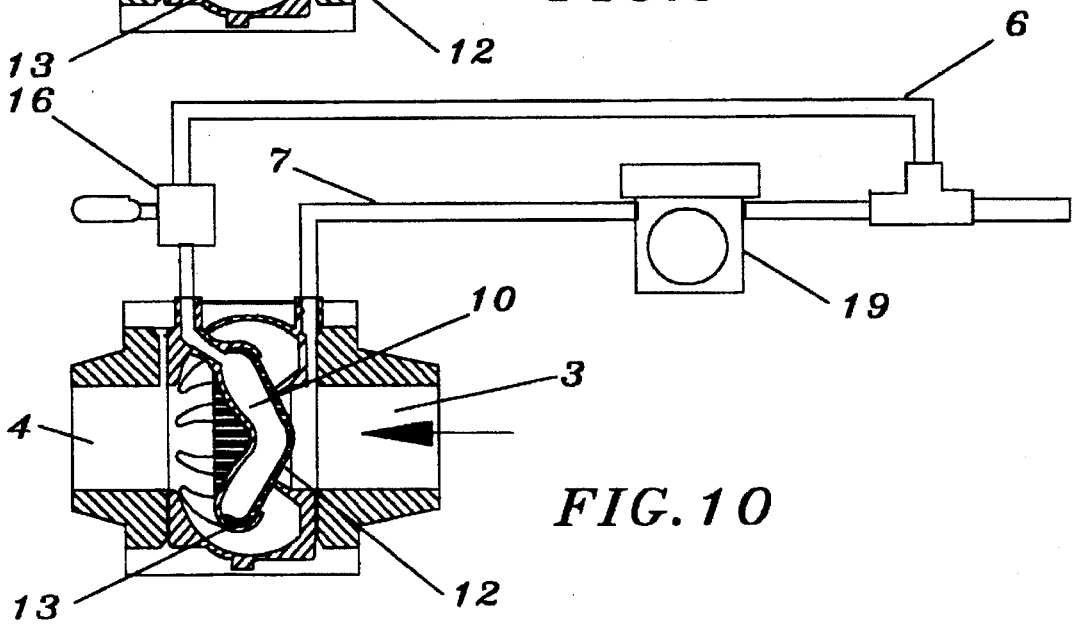
FIG. 10 illustrates a side schematic view of the fluid control valve in the closed position.

The fluid control features of this configuration as illustrated in FIG. 9 and 10 are typical of popular fluid control valves such as the "ROLL SEAL" brand throttling control valve disclosed in U.S. Pat. No. 4,198,029 and hereby incorporated by reference. Air pressure is introduced into the fluid control valve (21) and pressure vessel (20) such that the pressure on the inlet side (3) and in the control chamber (10) equalize through the pilot valve line (6) with the pilot control valve (16) closed. Once the air pressure is at the selected pressure level as controlled by gas regulator (19) the sports object launcher is ready to launch the object in the aiming channel (23) illustrated as a hockey puck (32).

When the pilot control valve (16) is opened the pressure in the control chamber (10) is lowered via pilot valve line (6) which results in the liner (12) collapsing against the control chamber cavity wall (13). This collapse allows the rapid release of the pressure vessel (20) air into the outlet side (4) of the fluid control valve (21) and into the aiming channel (23). This air pressure against the hockey puck (32) forces the hockey puck (32) to be launched from the aiming channel (23).

The fluid control valve (21) may have a safety valve (not shown) to prevent excessive pressure in the pressure vessel (20) and fluid control valve (21).

The automatic loader (9) as further illustrated in FIG. 11 is threaded into the aiming channel (23) at the loading end (40) to deposit a hockey puck (32) into the aiming channel (23). There is a loading tube (33) with a loading cap (34) having a seal (41) and hold down screws (42) to retain the hockey pucks (32) against the force of the released air pressure when a hockey puck (32) is launched from the aiming channel (23). A guide shaft (34*a*) may also be provided.

The shape of the aiming channel (23) may be changed to a circular cross section in order to be used with balls such as tennis or baseballs.

In one embodiment, an aiming control system (8)may be attached to the aiming channel (23) and fluid control valve (21) which system uses air pressure to aim the sports object launcher as illustrated in FIGS. 4 through 8. By use of commonly available position air cylinders (24,25) connected to the flow control valves (26*a*,26*b*,26*c*) and solenoid control valves (27*a*,27*b*,27*c*) which are connected to the coalescing filter (18) and gas compressor (2), the aiming channel (23) may be positioned to launch an object in a specific direction. Other systems such as electronic or mechanical threaded positioners may also be used.

Figure 5:
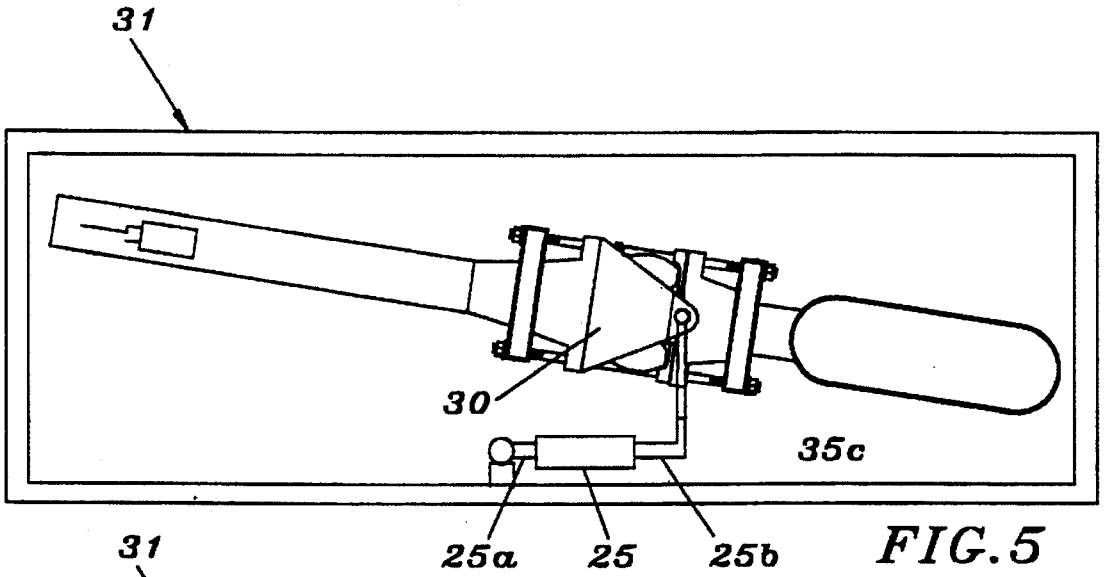
FIG. 5 illustrates the sports object launcher aimed left.
Figure 6:
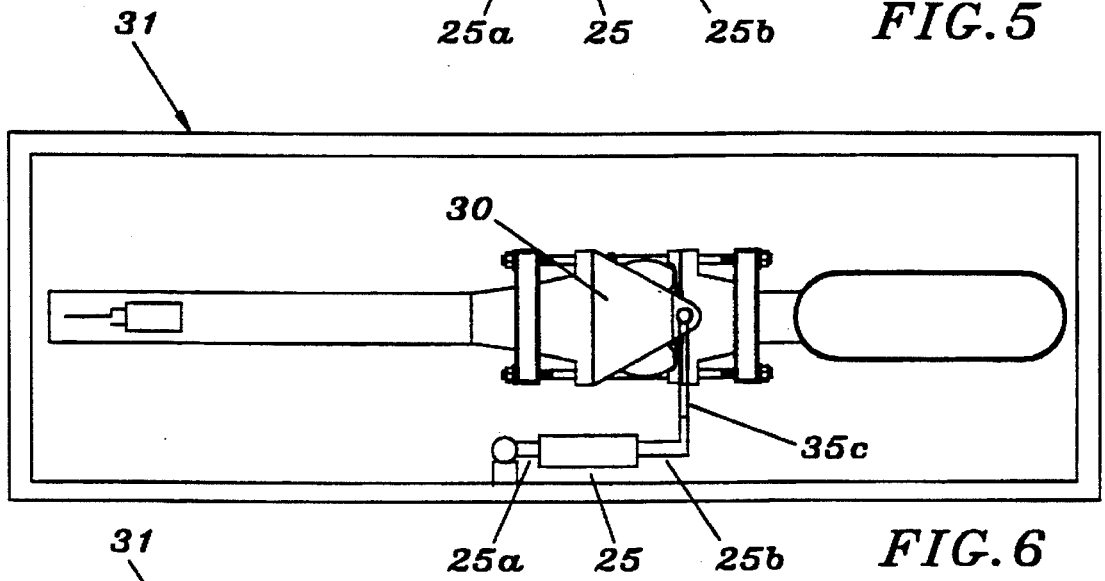
FIG. 6 illustrates the sports object launcher aimed center.
Figure 7:
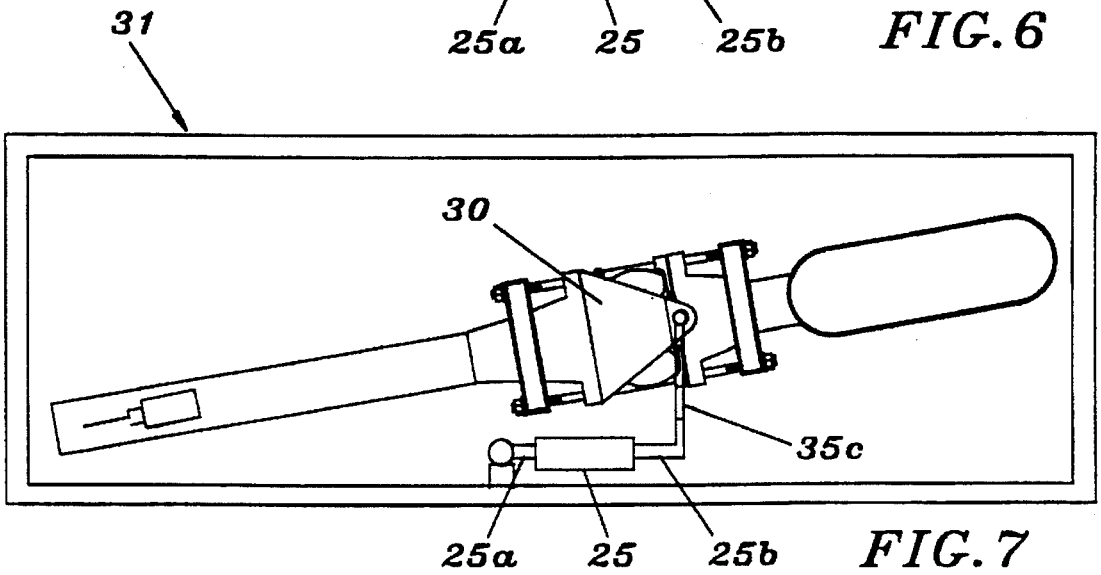
FIG. 7 illustrates the sports object launcher aimed right.
Figure 8:
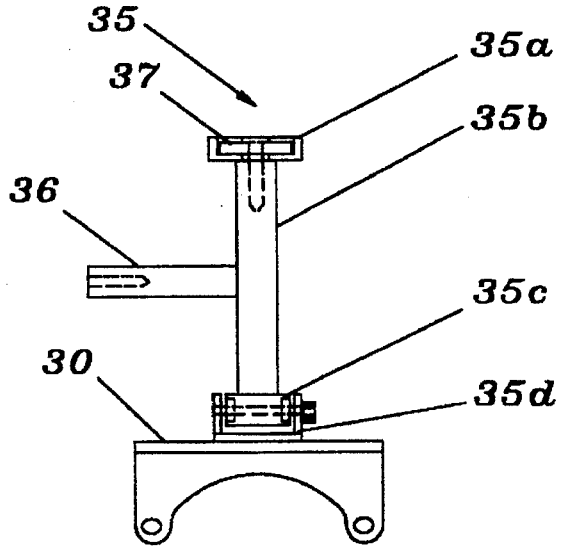
FIG. 8 illustrates the pivot assembly.

In the case of use with hockey pucks (32), the vertical dimension may be controlled for a high and low position by the use of a single air cylinder (24) connected to the main frame (31) by a hoist cable (24*b*). In the horizontal dimension a dual digital cylinder (25) could be used to give a right—center—left or 3 position control. As illustrated in FIGS. 5 through 7 the dual digital cylinder (25) has a frame piston arm (25*a*) attached to the main frame (31) and a valve piston arm (25*b*) attached to the pivot assembly (35). As a left flow control valve (26*b*) and right flow control valve (26*c*) are operated, the dual digital cylinder (25) functions to move the aiming channel (23) left or right. A pivot assembly (35) having a pivot arm (36) attached to the dual digital cylinder (25) with the pivot arm (36) connected to a main support shaft (35*b*) is illustrated in FIG. 8. The main support shaft (35*b*) is attached to the main frame (31) by a main bearing (35*a*) and on the other end to a pivot mounting plate (30) by a plate bearing (35*c*) and clevis (35*d*). The pivot mounting plate (30) is attached to the fluid control valve (21). For the hockey player to practice guarding the goal this provides quick change between these six important shooting points on the goal at the four corners and at the top and bottom middle position. A master control unit (11) may be used to provide electrical switch and variable control to the aiming control system (8) and pressure control system (5).

I claim:

1. A gas launching apparatus for launching objects comprising:

a fluid control valve attached to a pressure vessel at an inlet side and attached to an aiming channel at an outlet side;

a pressure control system for fluid control of the fluid control valve attached to the fluid control valve comprising a pilot valve line having a pilot control valve and a gas supply line having a gas regulator wherein the pilot valve line and gas supply line are connected through a coalescent gas filter to a gas compressor;

an aiming control system attached to the gas compressor and the coalescent filter comprising, an up/down flow control valve attached to an up/down gas cylinder which is attached to the aiming channel and an up/down gas cylinder piston attached to a main frame by a hoist cable, a left flow control valve attached to a dual digital cylinder and a right flow control valve attached to the dual digital cylinder wherein the dual digital cylinder is attached to the fluid control valve by a pivot assembly and is attached to the main frame; and a master control unit to operate the aiming control system and the pressure control system.

2. The apparatus as in claim 1 wherein the fluid control valve is a throttling control valve.

3. The apparatus as in claim 1 wherein the pivot assembly is comprised of a pivot arm attached to the dual digital cylinder with the pivot arm connected to a main support shaft attached to the main frame by a bearing and the main support shaft attached to a pivot mounting plate by a plate bearing wherein the pivot mounting plate is attached to the fluid control valve.

4. The apparatus according to claim 1 wherein there is an automatic loader comprising a loader magazine having a magazine cap with a seal and a means for attachment wherein there is a guide shaft attached to the magazine cap.

5. The apparatus according to claim 1 wherein the aiming channel is of rectangular cross section and is attached to the fluid control valve by a channel flow adapter.

* * * * *